United States Patent [19]

Butka

[11] Patent Number: 4,779,332

[45] Date of Patent: Oct. 25, 1988

[54] SAFETY RAZOR

[76] Inventor: Kemal Butka, 372 Central Park W., New York, N.Y. 10024

[21] Appl. No.: 120,114

[22] Filed: Nov. 3, 1987

Related U.S. Application Data

[63] Continuation-in-part of Ser. No. 936,705, Dec. 1, 1986, Pat. No. 4,754,547.

[51] Int. Cl.[4] ..... B26B 21/36

[52] U.S. Cl. ..... 30/46; 30/85

[58] Field of Search ..... 30/42, 44, 46, 51, 57, 30/85

[56] References Cited

U.S. PATENT DOCUMENTS

| | | | |
|---|---|---|---|
| 1,159,075 | 11/1915 | Nilson et al. | 30/46 |
| 1,249,021 | 12/1917 | Burke | 30/46 |
| 1,529,481 | 3/1925 | Gullborg | 30/46 |
| 2,060,687 | 11/1936 | Parkin | 30/46 |
| 2,137,327 | 11/1938 | Bertry | 30/46 |

*Primary Examiner*—E. R. Kazenske

*Assistant Examiner*—Michael D. Folkerts

*Attorney, Agent, or Firm*—Michael J. Striker

[57] ABSTRACT

A safety razor, comprises a handle element, a blade-carrying head element provided with at least one blade, a rotatable element having an axis and connected with the head element so as to rotate relative to the head element but jointly move in an axial direction, and a unit for imparting to the rotatable element a movement in the axial direction in response to contact of the rotatable element with a surface to be shaven, so that when user moves the handle element and therefore the head element in a predetermined direction during shaving, the rotatable element and therefore the head element of the blade is displaced in a direction which is tranverse to the predetermined direction in response to rotation of the rotary element, the imparting unit including a shaped grove provided in the rotary element and a spherical member arranged between the handle element and their rotatable element and movably engageable in the groove of the rotatable element.

5 Claims, 1 Drawing Sheet

SAFETY RAZOR

CROSS-REFERENCE TO RELATED APPLICATION

This application is a continuation-in-part of patent application Ser. No. 936,705, filed on Dec. 1, 1986, now U.S. Pat. No. 4,754,547.

BACKGROUND OF THE INVENTION

The present invention relates generally to safety razors. The term "safety razors" is used here to identify such razors which are widely utilized for personal use as opposed to barber razors and as opposed to electrical shaving razors. The present invention deals both with such safety razors which are completely disposable after use together with their handle and also to such razors in which a blade holding cartridge is disposable and the handle can be reused.

Safety razors are widely known and used for shaving. A known safety razor is provided with at least one blade whose shaving action strictly corresponds to the direction of movement of the safety razor. When the blade is pressed against a surface to be shaven the safety razor moves in respective direction along this surface, the blade cuts the hairs by a cutting component acting only in the direction of movement of safety razor.

In the application Ser. No. 936,705 the construction was proposed in which a rotary element was arranged to rotate in response to contact with a surface to be shaven during shaving and connected with a head element arranged to carry the blade, so that when the user moves the handle element and therefore the head element in a predetermined direction during shaving, the head element and therefore the blade is displaced also in a direction which is transverse to the direction of movement of the head element. As a result of this, in addition to a component which acts in direction of movement of the safety razor, also a component which extends transversely to the first component is produced, and therefore the cutting action of the blade is improved. In the construction disclosed in the above specified patent application there is a danger that when a surface to be shaven is very smooth and clean, the friction between this surface and the rotary element is very low and the rotary element stops rotating so that no longer the transverse component is imparted to the blade.

SUMMARY OF THE INVENTION

Accordingly, it is an object of the present invention to provide a safety razor which avoids the disadvantages of the prior art.

More particularly, it is an object of the present invention to provide such a safety razor in which the cutting force of a blade, in addition to a component acting in the direction of movement of the safety razor, also has a component which extends transversely to the first component, and this action is produced even in the event if a surface to be shaven is very smooth and clean.

In keeping with these objects and with others which will become apparent hereinafter, one feature of the present invention resides, briefly stated, in a safety razor which has a handle element, a head element carrying a blade, and a rotatable element arranged to rotate during shaving under the action of a frictional contact with a surface to be shaven and connected with the head element, and means for imparting an axial displacement to the rotatable element and including a shaped groove provided in the rotatable element and a spherical member located between said rotatable element and said handle element and movably engageable in the groove.

When the safety razor is designed in accordance with the present invention, the frction inside the razor blade reaches a minimum value because of the provision of the rotatable spherical member. Therefore, even with a very clean and smooth surface to be shaven and therefore with a very low friction between such a surface and the rotatable element, the rotatable element will still rotate and displace transversely in response to its contact with this surface.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
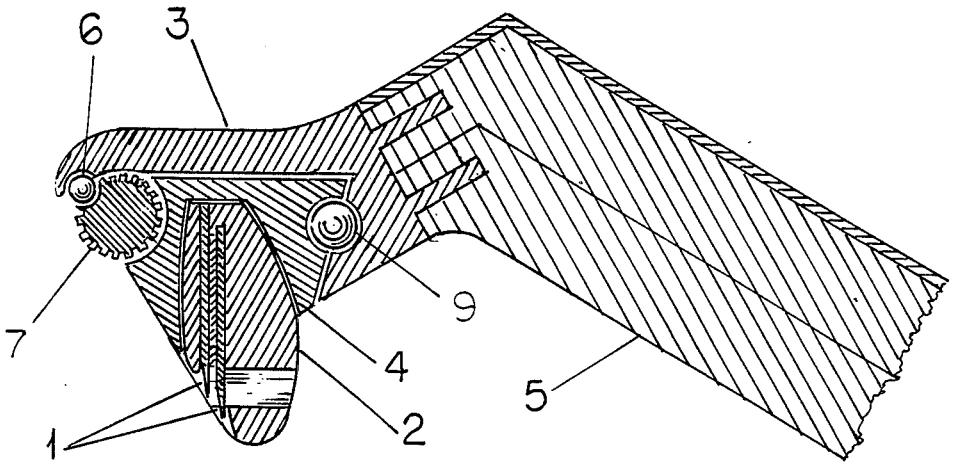
FIG. 1 is a side view of a safety razor in accordance with the present invention, in a section taken along the line A—A in FIG. 2.
Figure 2:
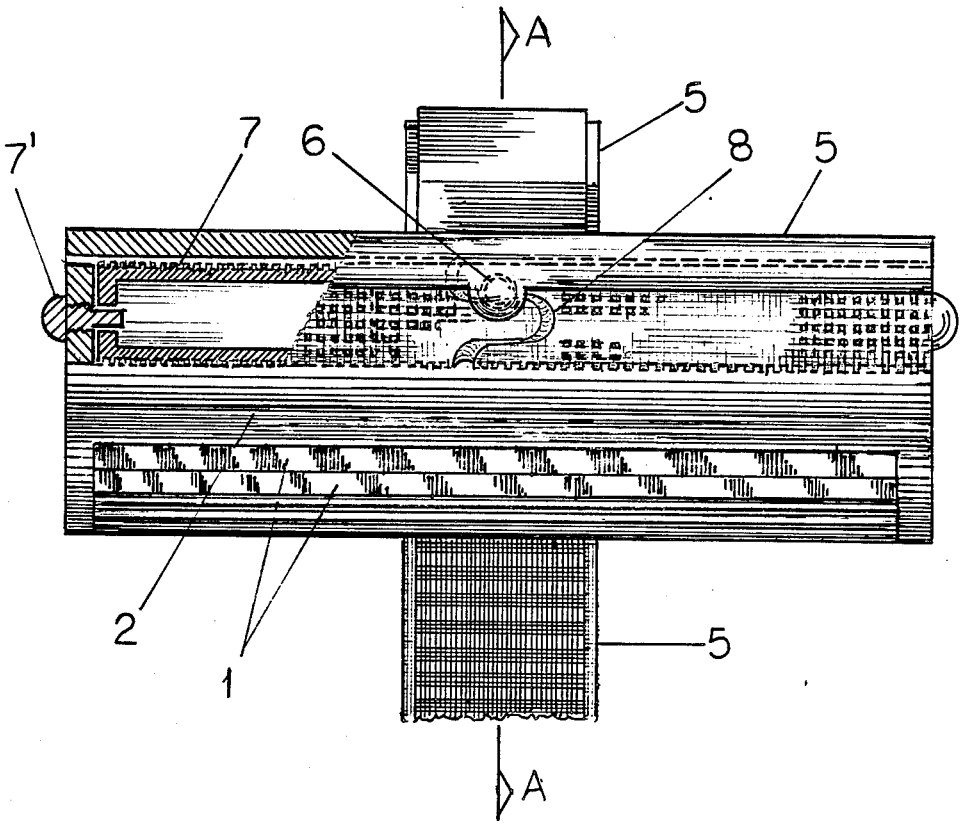
FIG. 2 is a front view of the safety razor of FIG. 1.

A safety razor in accordance with the present invention has a handle element to be held by a user. The handle element shown in FIG. 1 has a handle part 5 and a transition part 3 connected with the handle part by interengaging grooves and projections. It is to be understood that the handle element can be formed not in two parts but as a one-piece element as well.

The safety razor of the invention further has a head element. The head element includes a blade carrying member 2 with at least one blade. Two such blades 1 are shown as provided in the blade carrying member 2. The head member also includes a holding member 4 which releasably holds the blade carrying member 2. It is to be understood that the blades 1 can be held fixedly and non-removably in the blade carrying member 2. On the other hand, they can be arranged so that they can be removed from the blade carrying member 2 and replaced by new blades. The blade carrying member 2 also can be arranged either fixedly and non-removably in the holding member 4, or removably so as to be removed and replaced by a new blade carrying member.

The safety razor of the invention is further provided with a rotary element 7 arranged substantially in a front region of the head element. The rotary element 7 is cylindrical and is arranged in a complementary recess provided in the front portion of the holding member 4 of the head element so as to rotate relative to the head element.

The end portions of the rotary element 7 are provided with axial openings. The holding member 4 is provided with end plates also having axial openings. Pins 7' extend through the axial openings of the end plates of the holding member 4 and the axial openings of the rotary element 7. As can be seen from the drawings, each pin has a portion of a smaller diameter which extends through the opening of the respective end of the rotary element with a clearance therebetween so as to allow the rotation of the rotary element.

The rotary element 7 is provided with a shaped groove which is identified with reference numeral 8. A spherical member 6 is arranged between the handle element and the rotary element so as to movably (slidingly) engage into the shaped groove 8 of the rotary element. As can be seen from the drawings, the spherical member 6 also engages in a spherical recess in the handle element or more particularly in its transition part.

During shaving a user moves the handle element and therefore the head element with the blade 1 in a predetermined direction, for example in a substantially vertical direction downwardly. The rotary element 7 is pressed against a surface to be shaven and rotates because of the frictional contact with the surface. Since the spherical member 6 engages in the shaped groove 8, the rotation of the rotary member 7 simultaneously causes its transverse displacement in an axial direction. This transverse displacement is transferred to the head element connected with the rotary element, and therefore, the head element together with the blades 1 also performs, in addition to the movement imparted to the safety razor by a user, a transferse displacement in a direction which is transverse to the above mentioned vertical direction.

The provision of the spherical member 6 dramatically reduces the friction between the rotary element and the other parts of the safety razor. Therefore, even when a surface to be shaven is relatively clean and smooth, a small friction between such a surface and the rotary element still causes the rotation of the rotary element and thereby the transverse displacement of the rotary element and the head element with the blades.

As can be seen from the drawings, an additional spherical member 9 is arranged between the head element and the handle element rearwardly of the spherical member 6. The spherical member 9 is located in a semi-cylindrical recess provided in the handle element and a spherical recess provided in the head element, or vice versa. It performs guiding functions, for guiding the head element during its transverse displacement relative to the handle element.

It will be understood that each of the elements described above, or two or more together, may also find a useful application in other types of constructions differing from the types described above.

While the invention has been illustrated and described as embodied in a safety razor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A safety razor, comprising a handle element; a blade-carrying head element provided with at least one blade; a rotatable element having an axis and connected with said head element so as to rotate relative to said head element buy jointly move in an axial direction; and means for imparting to said rotatable element a movement in the axial direction in response to contact of said rotatable element with a surface to be shaven, so that when a user moves said handle element and therefore the head element in a predetermined direction during shaving, said rotatable element and therefore said head element with said blade is displaced in relative to said handle said axial direction which is transverse to said predetermined direction in response to rotation of said rotatable element, said imparting means including a shaped groove provided in said rotatable element and a spherical member which is arranged freely rotatably in all directions between said handle element and said rotatable element to said handle element and said such that said spherical member is freely rotatable relative.

2. A safety razor as defined in claim 1, wherein said handle element is provided with a semi-spherical groove, said spherical member being also engageable in said semi-spherical groove of said head element.

3. A safety razor as defined in claim 1, wherein said head element has a substantially semi-cylindrical recess formed so that said rotatable element is at least partially received in said semi-cylindrical recess and rotatable in it.

4. A safety razor as defined in claim 1; and further comprising means for guiding said head element during its displacement relative to said handle element in said axial direction, said guiding means including an additional spherical member arranged between said handle element and said head element.

5. A safety razor comprising, a handle element; a blade carrying head element provided with at least one blade; a rotatable element having an axis and connected with said head element so as to rotate relative to said head element but jointly move in an axial direction; means for imparting to said rotatable element a movement in the axial direction in response to contact of said rotatable element with a surface to be shaven, so that when a user moves said handle element and therefore the head element in a predetermined direction during shafing, said rotatable element and therefore said head element with said blade is displaced in a direction which is transverse to said predetermined direction in response to rotation of said rotatable element, said imparting means including a shaped groove provided in said rotatable element and a spherical member arranged between said handle element and said rotatable element and movably engaged in said groove of said rotatable element; and means for guiding said head element during its displacement relative to said handle element in said axial direction, said guiding means including an additional spherical member arranged between said handle element and said head element, said handle element and said head element forming first and second elements, one of said first and second elements having a substantially semi-cylindrical recess while the other of said first and second elements having a substantially spherical recess, said additional spherical member being received in said semi-cylindrical and said semi-spherical recesses of said first and second elements.

* * * * *